US009334641B2

(12) United States Patent
Kobal

(10) Patent No.: US 9,334,641 B2
(45) Date of Patent: May 10, 2016

(54) ANTI-SPLASH SANITARY URINAL SCREEN

(71) Applicant: Mark Kobal, Prague (CZ)

(72) Inventor: Mark Kobal, Prague (CZ)

( * ) Notice: Subject to any disclaimer, the term of this patent is extended or adjusted under 35 U.S.C. 154(b) by 177 days.

(21) Appl. No.: 14/266,138

(22) Filed: Apr. 30, 2014

(65) Prior Publication Data

US 2015/0284940 A1 Oct. 8, 2015

Related U.S. Application Data

(63) Continuation-in-part of application No. 14/243,766, filed on Apr. 2, 2014, now abandoned.

(51) Int. Cl.
*E03D 9/00* (2006.01)
*E03D 13/00* (2006.01)

(52) U.S. Cl.
CPC ..... *E03D 13/005* (2013.01)

(58) Field of Classification Search
CPC ..... E03D 13/005; E03D 9/00
USPC ..... 4/301, 309, 222, 222.1, 1
See application file for complete search history.

(56) References Cited

U.S. PATENT DOCUMENTS

| | | | | |
|---|---|---|---|---|
| 487,130 | A | 11/1892 | Schoen | |
| 647,895 | A | 4/1900 | Burson | |
| 1,880,962 | A | 10/1932 | Koppelman | |
| 3,597,772 | A | 8/1971 | Leavitt et al. | |
| 3,760,429 | A | 9/1973 | Brownstein | |
| 4,134,162 | A * | 1/1979 | Sharland | E03C 1/264 4/292 |
| 4,135,261 | A | 1/1979 | Uhrman | |
| 4,574,400 | A | 3/1986 | Annowsky | |
| 4,574,403 | A | 3/1986 | Dintemann | |
| 5,165,119 | A | 11/1992 | Yamato | |
| 5,313,672 | A | 5/1994 | Luedke et al. | |
| 5,365,616 | A | 11/1994 | Morad | |
| 5,604,937 | A | 2/1997 | Davenport | |
| 5,774,905 | A | 7/1998 | Wager et al. | |
| 6,588,029 | B2 * | 7/2003 | Mullings | E04H 4/1236 4/286 |
| 6,698,035 | B1 | 3/2004 | Grueser | |
| 6,920,648 | B1 | 7/2005 | Suski et al. | |
| 2013/0031708 | A1 * | 2/2013 | Sensel | E03D 13/005 4/309 |

FOREIGN PATENT DOCUMENTS

GB 2261611 A * 5/1993

* cited by examiner

*Primary Examiner* — Huyen Le
*Assistant Examiner* — Christine Skubinna
(74) *Attorney, Agent, or Firm* — Louis Ventre, Jr.

(57) ABSTRACT

An anti-splash sanitary urinal screen has components including a flat base, an outer cup, an inner cup and a mesh screen. The flat base has a lattice work permitting the passage of liquid through it and defining assembly slots that are used to hold the components together. The outer cup flexes when squeezed, allowing tabs to pass through the assembly slots to lock the components together. The outer cup has a first open window through a domed area of the cup. The inner cup has a second open window of approximately the same size. The inner cup has a shape conforming to the outer cup such that the inner cup fits within the outer cup so that they may be nested together with the windows aligned. The mesh screen fills the space between the outer cup and the inner cup so that liquid may flow through the windows and screen.

2 Claims, 7 Drawing Sheets

ANTI-SPLASH SANITARY URINAL SCREEN

CROSS-REFERENCE TO RELATED APPLICATIONS

This application is a continuation-in-part of application Ser. No. 14/243,766, filed 2 Apr. 2014, which is hereby incorporated by reference herein.

TECHNICAL FIELD

In the field of baths, closets, sinks, and spittoons, an anti-splash urinal screen is disclosed.

BACKGROUND ART

Urinal screens come in many shapes from a perforated flat mat to a mat with an inverted bowl to hold a deodorant cake, usually centered on the mat. The bowl is typically a lattice work of holes so that liquid can pass through after wetting the deodorant cake. The typical urinal screen prevents loss of the deodorant cake down the drain when the cake dissolves to a small size.

SUMMARY OF INVENTION

An anti-splash sanitary urinal screen has four primary components including a flat base, an outer cup, an inner cup and a mesh screen. The flat base has a lattice work permitting the passage of liquid through it and defining assembly slots that are used to hold the components together. The outer cup flexes when squeezed allowing two or more tabs to pass through these assembly slots in the flat base to lock the components together. The outer cup has a first open window through a domed area of the cup. The inner cup has a second open window of approximately the same size. The inner cup has a shape conforming to the outer cup such that the inner cup fits within the outer cup so that they may be nested together with the windows aligned. The mesh screen fills the space between the outer cup and the inner cup to cover the windows so that water may flow through the first open window through the screen and then through the second open window.

Technical Problem

Present designs of urinal screens have a lattice design that causes splash-back on the urinal user. A urinal screen design is needed that minimizes splash-back, yet is easy to assemble and disassemble.

Solution to Problem

The solution is a four component sanitary urinal screen having a flat base, two cups that nest together and a mesh screen placed between them. Each cup has a window through it, so that when the two cups are nested together the windows align. The mesh screen is located between the windows of the nested cups so that the liquid can pass through the screen on its way through the aligned windows.

Advantageous Effects of Invention

The anti-splash sanitary urinal screen according to the disclosure herein minimizes splash-back on the urinal user.

The outer cup with a solid surface around its window serves to catch spray and eliminate splashes.

BRIEF DESCRIPTION OF DRAWINGS

The drawings illustrate a preferred embodiment of the anti-splash sanitary urinal screen according to the disclosure. The reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate a preferred embodiment of the anti-splash sanitary urinal screen. The drawings and the preferred embodiment of the invention are presented with the understanding that the present invention is susceptible of embodiments in many different forms and, therefore, other embodiments may be utilized and structural, and operational changes may be made, without departing from the scope of the present invention.

Figure 1:
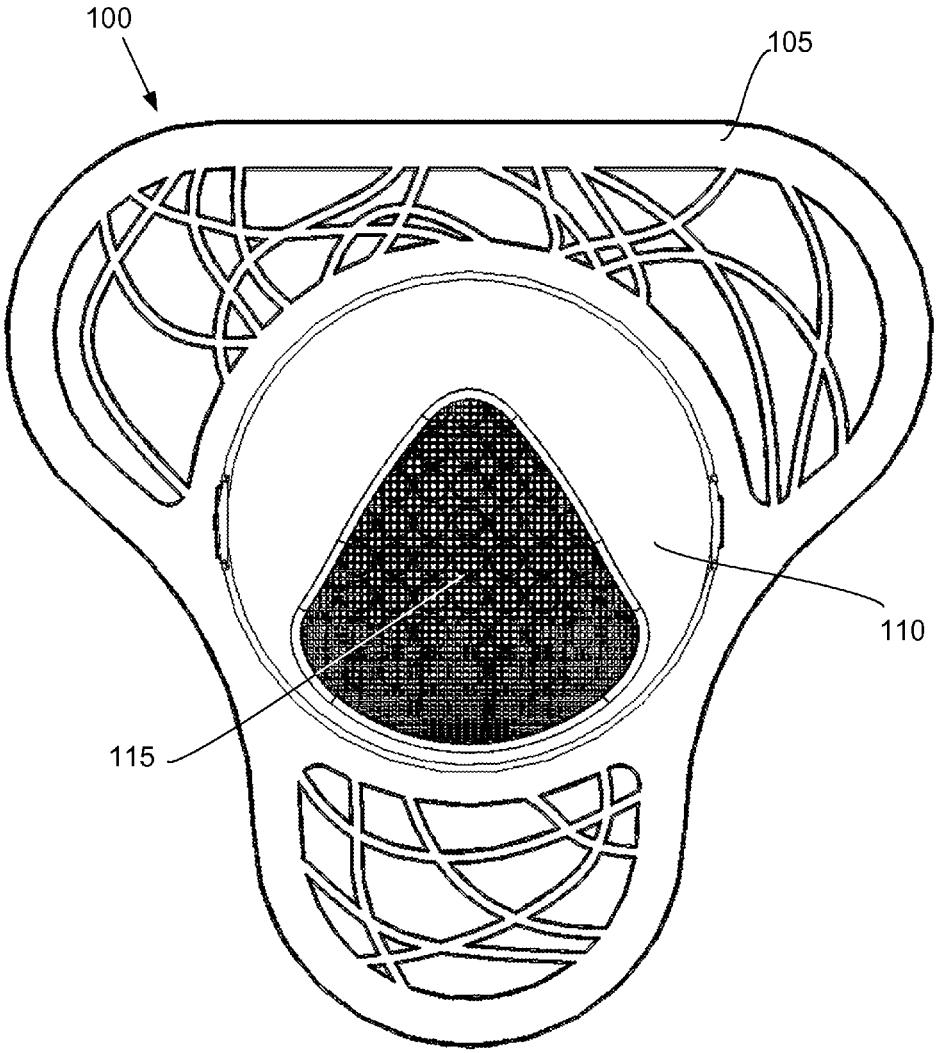
FIG. 1 is a top view of the anti-splash sanitary urinal screen.
Figure 3:
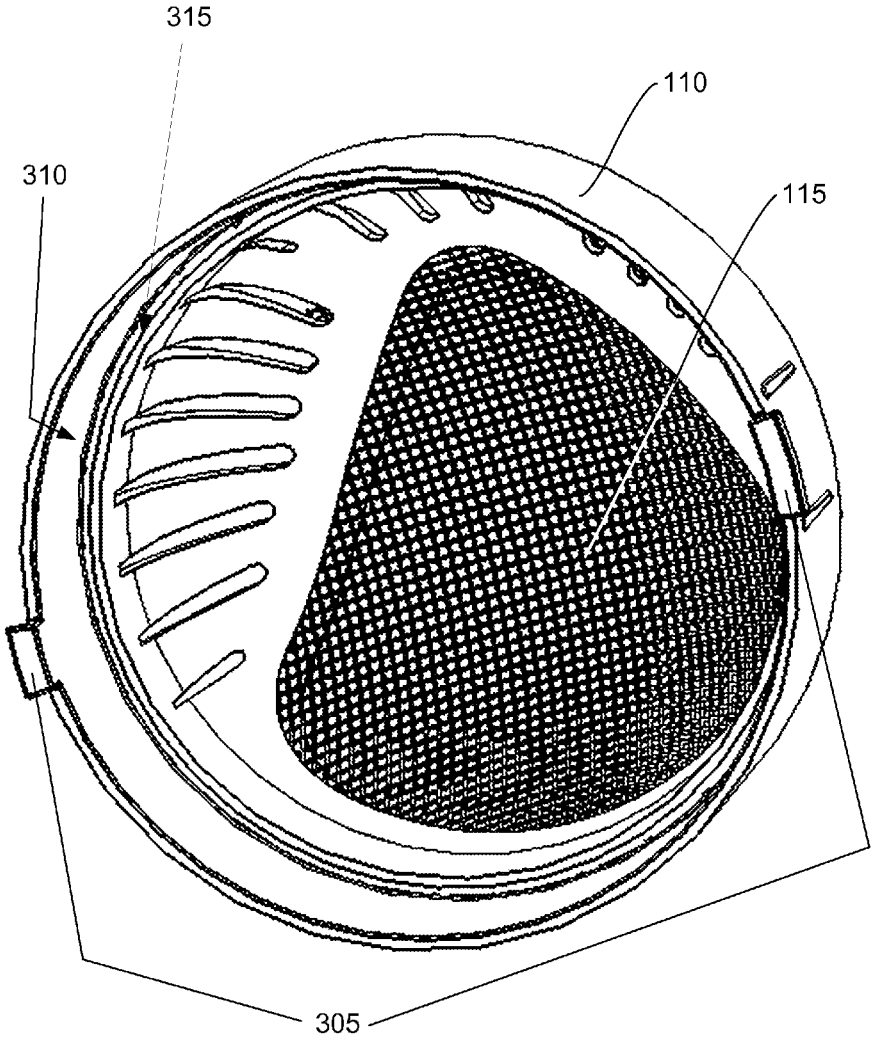
FIG. 3 is a bottom perspective view of the assembled inner cup and mesh screen within the outer cup of the anti-splash sanitary urinal screen of FIG. 1.
Figure 4:
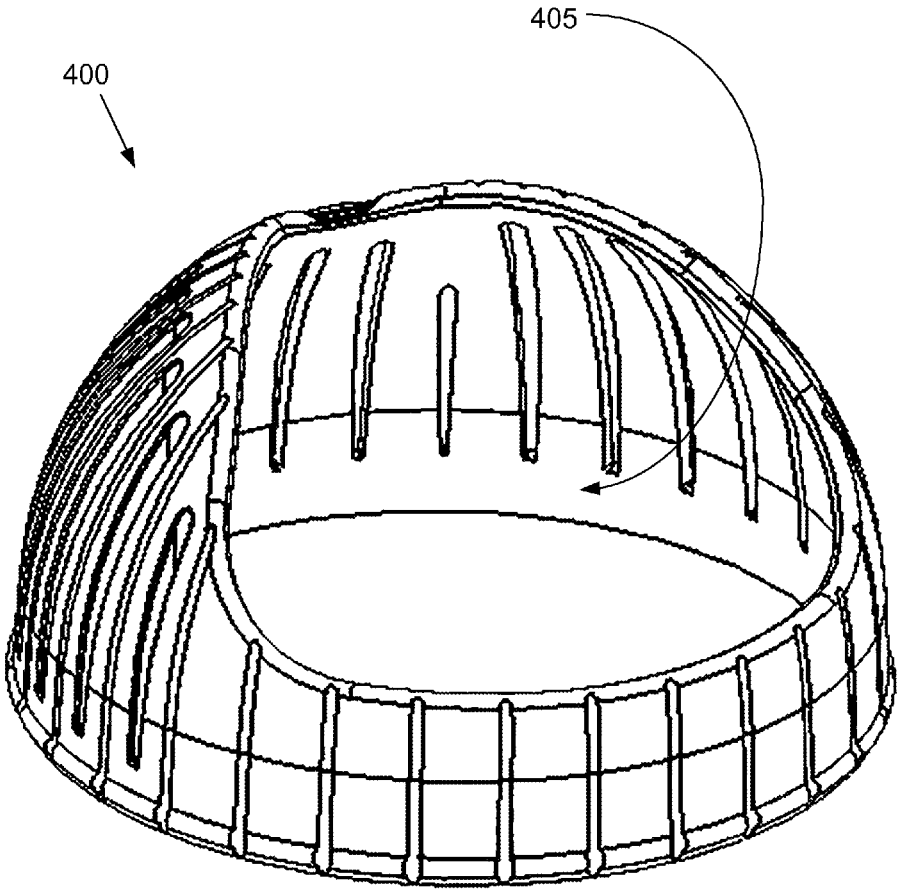
FIG. 4 is a perspective of the inner cup of the anti-splash sanitary urinal screen of FIG. 1.

FIG. 1 is a top view of assembled components making up an anti-splash sanitary urinal screen (100) in conformance with the disclosure herein. The anti-splash sanitary urinal screen (100) includes a flat base (105); an outer cup (110); an inner cup (400), more easily seen in FIG. 4; and a mesh screen (115). A view inside the outer cup with the inner cup within is shown in FIG. 3. The components are preferably made of a semi-rigid plastic, able to bend and flex under force.

The flat base (105) defines a lattice work (205) the function of which is to permit the passage of liquid therethrough. The lattice work includes arced passages and holes that do not affect the ability of the flat base (105) to hold the outer cup, but permit water to readily flow through the flat base (105) such that if it were sitting within a urinal, water would not be prevented from flowing out of the urinal upon flushing. The flat base (105) also defines a plurality of assembly slots (210), preferably two such slots positioned about 180 degrees apart. When more than two such slots are present, they are preferably equidistant from each other. Each such slot is positioned to receive a tab, in a plurality of tabs (305) extending from the bottom of the outer cup (110). The outer cup (110) is flexible such that when it is flexed each such tab may squeeze into the slot to hold the components of the anti-splash sanitary urinal screen (100) together.

The outer cup (110) includes a bottom portion (505); a top portion (510); and the plurality of tabs (305) mentioned above. Each tab in the plurality of tabs (305) extends from the bottom portion (505). Each tab in the plurality of tabs (305) is insertable into one of the assembly slots in the plurality of assembly slots (210) in the flat base (105) so as to detachably secure the outer cup (110) to the flat base (105). Preferably, this tab and slot assembly holds the components of the anti-splash sanitary urinal screen (100) together in a unified structure that can be non-destructively disassembled.

The bottom portion (505) of the outer cup (110) includes an open cross-section (310). An open cross-section is simply the open end of the cup. The terminology of "cup" is used to suggest similarity to an ordinary cup, such as a coffee cup but without the finger loop. A soup bowl may be a more apt mental image.

Figure 5:
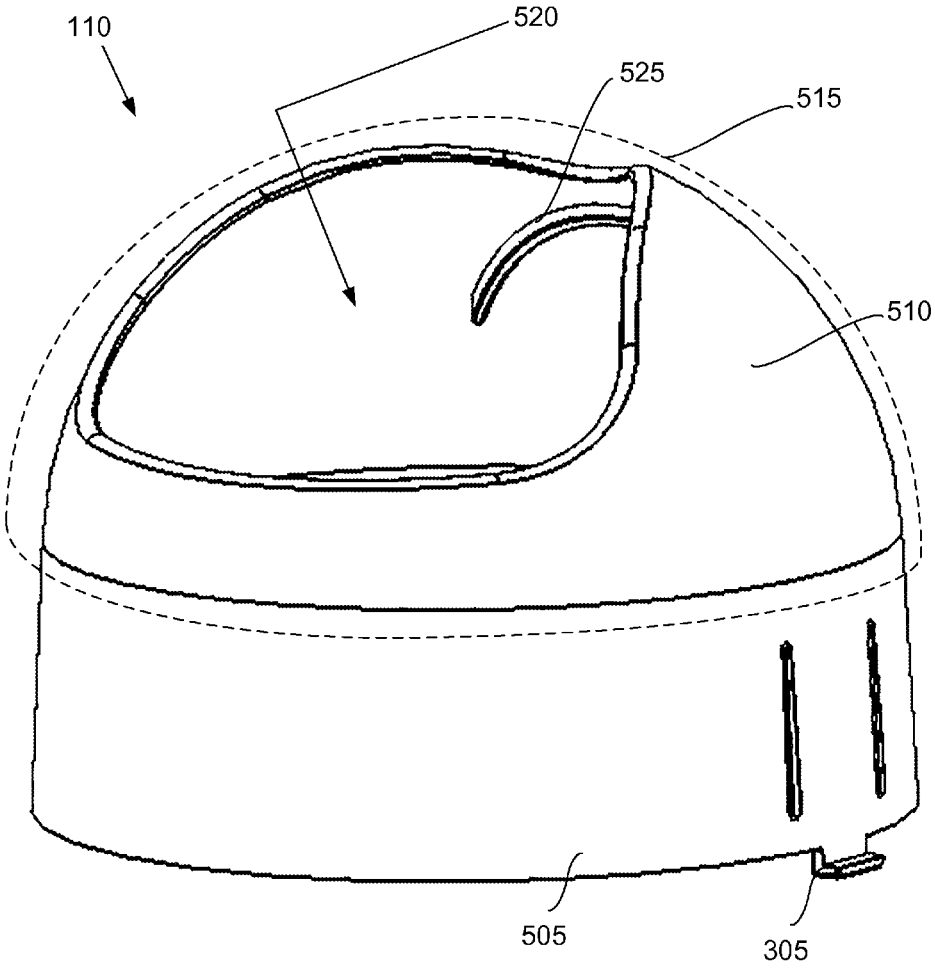
FIG. 5 is a front elevation view of the outer cup of the anti-splash sanitary urinal screen of FIG. 1.
Figure 6:
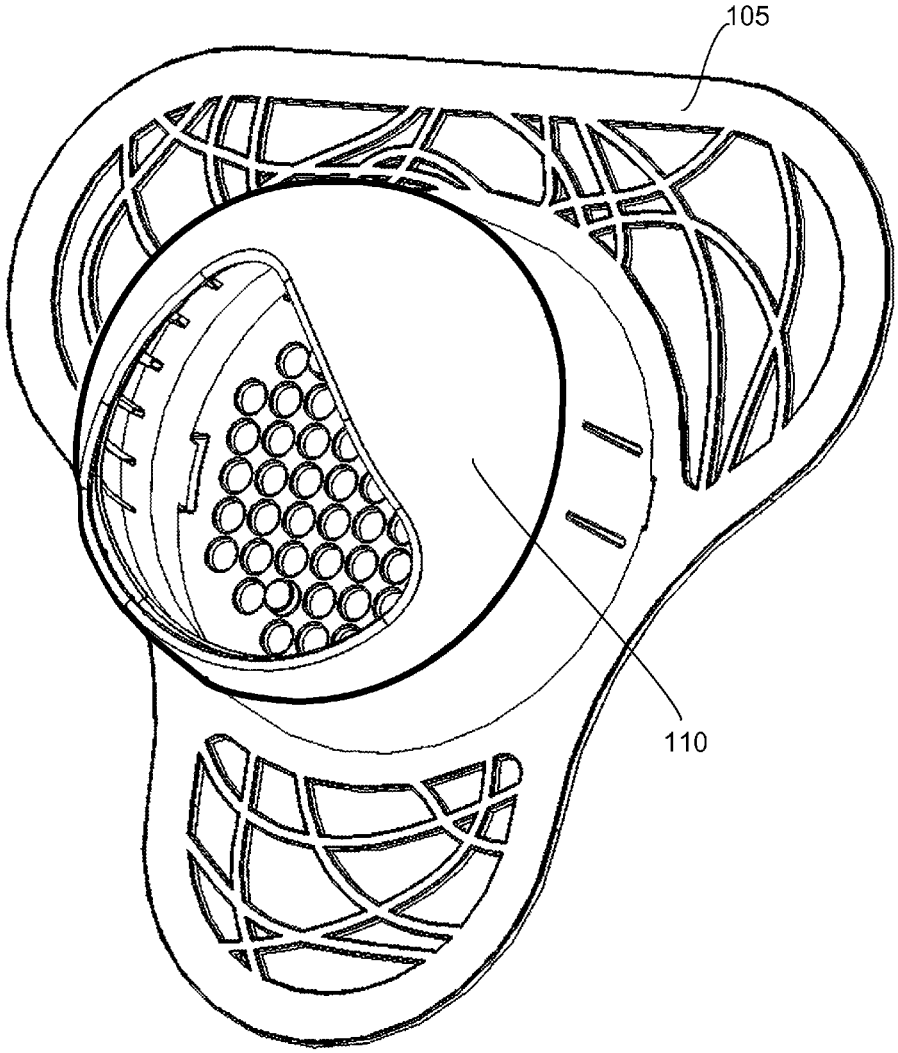
FIG. 6 is a perspective view of the assembled flat base, inner cup and outer cup without the mesh screen.

The top portion (510) of the outer cup (110) includes a domed hemisphere (515), identified within the dashed enclosure of FIG. 5. The outer cup (110) defines a first open window (520) through the domed hemisphere (515). The first open window (520) is preferably a roughly triangular shape with a vertex near the top of the domed hemisphere (515), as shown in FIG. 5. Preferably, there are no slats, cross-bracing or other obstructions in the first open window (520), such that the first open window (520) comprises a vacant area carved out of the outer cup (110). Aside from the first open window (520), the domed hemisphere (515), preferably, has a solid surface, that is it is without other perforations or penetrations therethrough.

The inner cup (400) has a shape that conforms to the outer cup (110) such that the inner cup (400) fits within the outer cup (110), preferably creating a snug fit when the inner cup (400) is nested within the outer cup (110). The inner cup (400) is smaller than the outer cup (110) so that the two cups may be nested together.

The inner cup (400) defines a second open window (405) that is similarly sized with the first open window (520) of the outer cup (110). Thus, the second open window (405) is approximately coextensive with the first open window (520). Preferably, there are no slats, cross-bracing or other obstructions in the second open window (405), such that the second open window (405) comprises a vacant area carved out of the inner cup (400). This arrangement permits the two windows to line up when assembled together so that liquid may pass through both windows when the anti-splash sanitary urinal screen (100) is in use.

The outer cup (110) is preferably sized to contain a urinal deodorizer block, which is also commonly referred to as a urinal cake, a non-para block, a urinal mint, a urinal puck, a urinal peon (pronounced pee-on), a urinal biscuit, a urinal cooky, or a urinal donut. A urinal deodorizer bloc is often fabricated to release a disinfectant in the urinal as it slowly dissolves from liquid running over it.

Preferably, the mesh screen (115) occupies the space between the first open window (520) and the second open window (405). The mesh screen (115) allows liquid to pass through the first open window (520) and the second open window (405), while minimizing splash so that liquid passes through the mesh screen (115) on its way over any urinal cake that is present, then to the flat base (105) and thence to the urinal drain below. The solid surface of the back of the outer cup (110) catches any spray resulting from the impact of liquid on the urinal cake. For assembly, the mesh screen (115) is within the space inside the first open window (520) and then the inner cup (400) is inserted into the outer cup (110) and the tabs on the outer cup (110) are inserted into the plurality of assembly slots (210) in the flat base (105).

Alternatively, the mesh screen (115) covers the first open window (520), either on the inside or the outside of the first open window (520). Preferably, for assembly of this alternative embodiment, the mesh screen (115) is placed beneath (inside) the first open window (520) on the inside of the outer cup (110) and then the inner cup (400) is inserted into the outer cup (110) with the tabs on the outer cup (110) being simultaneously inserted into the slots in the flat base (105).

A mesh screen (115) made of stainless steel is preferred because it is available using very small diameter wire that is sufficiently rigid to maintain its shape for the longest period of time and also because it will flex to fill the open windows without bunching up. Mesh using thinner diameter strands is preferred because the thinner the strand, the less splash back is experienced. An open area filled with mesh comprising about 40-55 percent of the surface area of the domed hemisphere is considered a preferable balance of open area to allow the passage of liquid through the mesh screen (115) with sufficient solid surface to catch spray and thus minimize splash-back.

Alternatively, the mesh screen (115) may be made of polyester and using monofilament thread to provide abrasion resistance, tolerance to the presence of acidic liquids, longevity and non-corrosive features. Nylon is another alternative material that is less sensitive than polyester to deterioration from alkalis commonly found in common cleaning fluids, such as bleach and ammonia. Of the two materials, polyester mesh is considered better because it is more acid resistant and holds up better in water then nylon mesh. Other plastics, such as polypropylene, may also be suitable mesh material. The surface of the mesh screen (115) may be flat or dimpled. Dimpling creates a myriad of reflection angles that diminishes splash back.

The mesh screen (115) may be embedded into either of the cups so that it is permanently fixed in place within a window, such as within the first open window (520) or within the second open window (405). Embedding may involve autoclave fabrication and in such circumstance a polyester mesh would be considered preferable because it holds up better in such fabrication environments.

Preferably, the mesh screen (115) roughly conforms to the shape of the domed hemisphere (515). Alternatively, the mesh screen (115) may be shaped to conform to the angled shape of the window in which it is installed: for example, in the second open window (405) of the inner cup (400) so that it is angled with respect to the surface of the domed hemisphere (515). Such alternative using the mesh screen (115) with an angled installation would limit splash back by directing any waste stream reflection to inward angles.

The outer cup (110) may include a ridge arm (525), preferably located inside of the outer dome, that engages the mesh screen (115) during assembly to control or limit movement of the mesh screen (115) during assembly.

The anti-splash sanitary urinal screen (100) is structured so that when the inner cup (400) and the mesh screen (115) are nested within the outer cup (110), the first open window (520) and the second open window (405) align and any liquid may flow through the first open window (520) through the mesh screen (115) and thence through the second open window (405).

The outer cup (110) may include a circumferential ridge recess (315) on the inside, or concave side, of the outer cup (110), so that the inner cup (400) snaps in place when nested in the outer cup (110). Alternatively, the inner cup (400) has an end rim that butts up against the flat base (105) so that the inner cup (400) is held nested against the outer cup (110) when the outer cup (110) is slightly flexed to squeeze the tabs through the assembly slots. Alternatively, the inner cup (400) may be glued to the outer cup (110).

Figure 2:
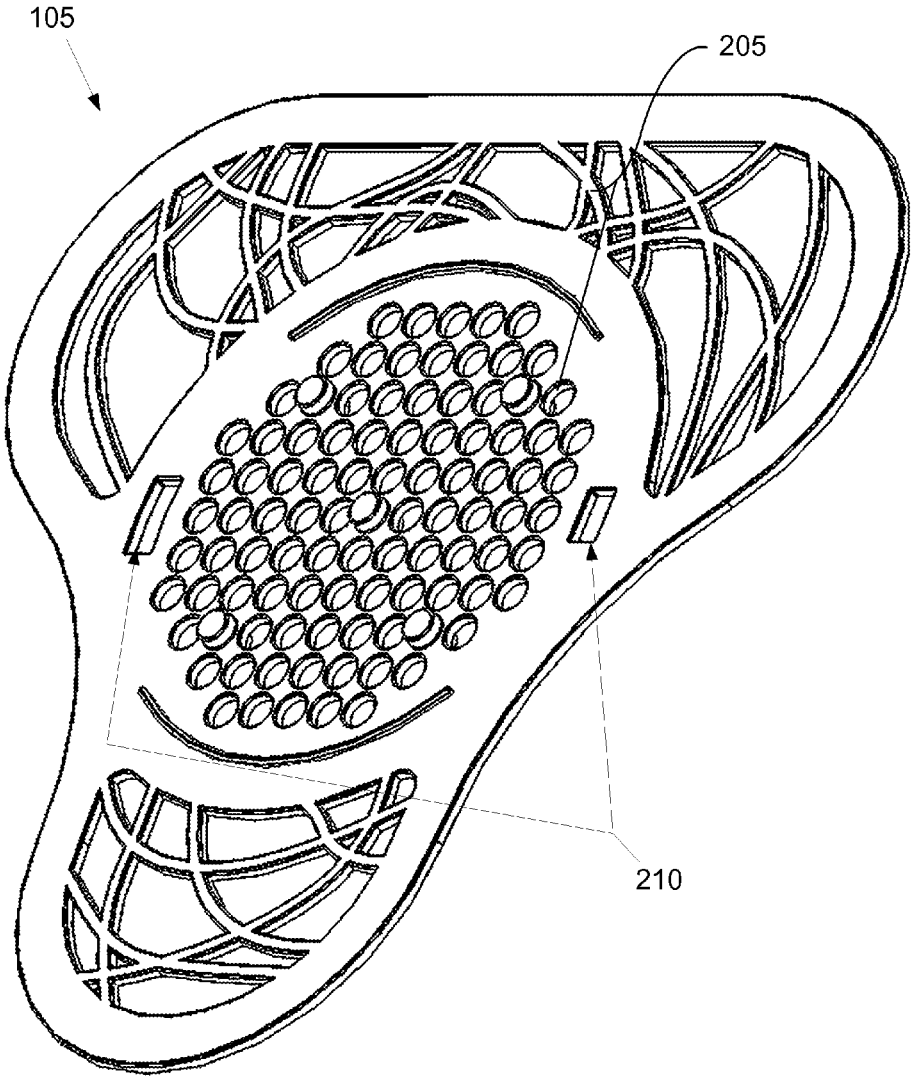
FIG. 2 is a perspective of the flat base of the anti-splash sanitary urinal screen of FIG. 1.
Figure 7:
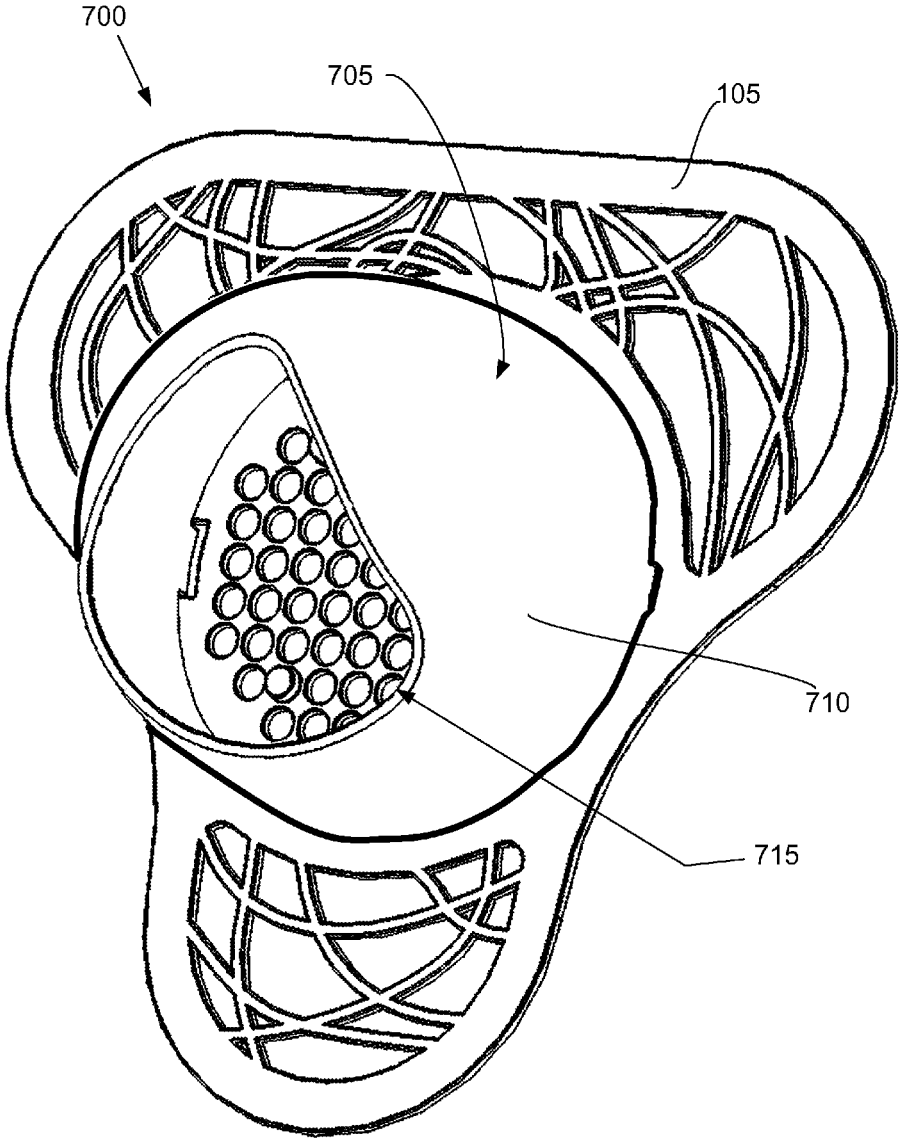
FIG. 7 is a perspective view of an alternative embodiment having no inner cup. The mesh screen is not displayed for clarity but would be present in this embodiment.

In an alternative embodiment shown in FIG. 7, an alternate anti-splash sanitary urinal screen (700) includes a flat base (105), a cup (710) and a mesh screen (115). The flat base (105) and mesh screen (115) is the same as shown in FIG. 1 and FIG. 2. As in the primary embodiment, the flat base (105) defines a lattice work (205) permitting passage of liquid therethrough and further defining a plurality of assembly slots (210). The cup (710) is essentially the same as the outer cup (110) in the primary embodiment. The cup (710) is a hemisphere (705) having a solid surface that defines an open window (715), which is essentially the same as in the first open window (520) in the primary embodiment. The open window (715) is also through the hemisphere (705). A plurality of tabs (305), as in the primary embodiment shown in FIG. 3, extend from the cup (710) at the open bottom of the hemisphere, each tab in the plurality of tabs being insertable into one of the assembly slots in the plurality of assembly slots (210) so as to detachably secure the cup to the flat base. The mesh screen (115) in this alternative embodiment is embedded within the cup (710) either on the inside or the outside of the cup (710), and covers the open window. The mesh screen (115) is the same mesh screen shown in FIG. 1 for the primary embodiment.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the janitorial supply industry.

What is claimed is:

1. An anti-splash sanitary urinal screen comprising:

a flat base defining a lattice work permitting passage of liquid therethrough and further defining a plurality of assembly slots;

an outer cup comprising a bottom portion; a top portion; and a plurality of tabs extending from the bottom portion, each tab in the plurality of tabs being insertable into one of the assembly slots in the plurality of assembly slots so as to detachably secure the outer cup to the flat base; the bottom portion comprising an open cross-section; the top portion consisting of a domed hemisphere having a solid surface that defines a first open window through the domed hemisphere, the first open window having a triangular shape with a vertex near the top of the domed hemisphere, the solid surface having no other penetration therethrough;

an inner cup, the inner cup having a shape conforming to the outer cup such that the inner cup fits within the outer cup so that they may be nested together; the inner cup defining a second open window that is approximately coextensive with the first open window, the inner cup configured to snap together with the outer cup when nested in the outer cup;

a mesh screen filling the space between the first open window and the second open window;

the outer cup further comprising a ridge arm located inside the domed hemisphere, the ridge arm configured to engage the mesh screen during assembly; and wherein when the inner cup and the mesh screen are nested within the outer cup, then the first open window and the second open window align to allow liquid to pass through the first open window through the mesh screen and thence through the second open window.

2. An anti-splash sanitary urinal screen comprising:

a flat base defining a lattice work permitting passage of liquid therethrough and further defining a plurality of assembly slots;

an outer cup comprising a bottom portion; a top portion; and a plurality of tabs extending from the bottom portion, each tab in the plurality of tabs being insertable into one of the assembly slots in the plurality of assembly slots so as to detachably secure the outer cup to the flat base; the bottom portion comprising an open cross-section; the top portion comprising a domed hemisphere defining a solid surface; the outer cup further defining a first open window through the domed hemisphere with having no other penetration through the solid surface;

an inner cup, the inner cup having a shape conforming to the outer cup such that the inner cup fits within the outer cup so that they may be nested together; the inner cup defining a second open window that is approximately coextensive with the first open window, the inner cup configured to snap together with the outer cup when nested in the outer cup;

a mesh screen covering the first open window;

the outer cup further comprising a ridge arm located inside the domed hemisphere, the ridge arm configured to engage the mesh screen during assembly; and wherein when the inner cup and the mesh screen are nested within the outer cup, then the first open window and the second open window align to allow water to flow through the first open window through the mesh screen and thence through the second open window.

* * * * *